US006129096A

United States Patent [19]

Johnson

[11] Patent Number: 6,129,096

[45] Date of Patent: Oct. 10, 2000

[54] DOG LITTER CLEAN UP KIT AND METHOD

[76] Inventor: Richard J. Johnson, 5612 18th St., Arlington, Va. 22205

[21] Appl. No.: 08/971,566

[22] Filed: Nov. 17, 1997

[51] Int. Cl.[7] ..... B08B 3/00

[52] U.S. Cl. ..... 134/34; 134/42; 294/1.3; 119/651; 119/867

[58] Field of Search ..... 134/42, 26, 28, 134/29, 34; 294/1.3, 1.4, 1.5; 119/165, 867, 651

[56] References Cited

U.S. PATENT DOCUMENTS

| | | | |
|---|---|---|---|
| 4,752,093 | 6/1988 | Haber et al. | 294/1.3 |
| 4,917,238 | 4/1990 | Schumacher | 206/223 |
| 4,957,131 | 9/1990 | Robinson | 134/175 |
| 5,167,377 | 12/1992 | Chalmers | 225/46 |
| 5,280,978 | 1/1994 | Bohn | 294/1.3 |
| 5,511,682 | 4/1996 | Pace | 220/404 |
| 5,564,762 | 10/1996 | Ring | 294/1.3 |
| 5,713,616 | 2/1998 | Knudson | 294/1.3 |
| 5,836,629 | 11/1998 | Hobart | 294/1.3 |

*Primary Examiner*—Jill Warden
*Assistant Examiner*—Alexander Markoff

[57] ABSTRACT

A cleanup kit designed to be used by a person walking a dog to enable him to remove any litter deposited by the animal and then to flush and sanitize the spot contaminated by the litter. The kit includes a bag and shoulder carrying strap. The bag includes multiple internal compartments for supporting the kit items which include a trigger sprayer, a flashlight, cleanup gloves, disposable litter bags, and a variety of other optional items. A bag insert is designed to convert a conventional bag to one having compartments to retain the kit items.

2 Claims, 2 Drawing Sheets

DOG LITTER CLEAN UP KIT AND METHOD

BACKGROUND OF THE INVENTION

This invention relates to a cleanup kit and method designed to be used by a person walking a dog or other pet to remove any litter deposited by the animal and then to rinse and sanitize the area. The method also provides for the flushing and neutralizing of animal urine.

A longstanding problem in urban and suburban areas involves dog owners who walk their pets but fail to clean up litter left by their animals. Large cities such as New York and Paris clean up literally tons of dog litter each day from the streets. Such litter is objectionable from many aspects including that of being an environmental health hazard. It is well known that animal feces contains harmful parasites and bacteria capable of causing severe health problems. Persons who walk on sidewalks or grass so littered may pick up such disease causing parasites and bacteria on their shoes and then transmit them into homes where they may be wiped off on rugs and carpets on which small children may play. Children playing on grass and other areas contaminated by dog litter have contracted serious illness from dog litter.

In residential areas there are few experiences more aggravating than to step in dog feces left in the grass along the sidewalk. Homeowners observing someone allowing a dog to litter on their nicely manicured lawn rightfully become upset.

While some dog owners make a attempt to pick up litter deposited by their animals it appears that the vast majority of persons walking dogs carry nothing with them to clean up their animals litter and are thus unprepared when such happens. It is painfully evident when such persons are observed that somewhere in that community animal feces will be deposited and which will then create an environmental nuisance and health hazard.

Local governments pass ordnances against such littering and homeowner associations pressure dog owners to clean up any litter that their pets deposit in the neighborhood, but with limited success. Citizens who complain of dog littering are advised to videotape or photograph dog owners and their animals in the act of littering in order to provide evidence for use in court to prosecute the dog owner.

Another serious aspect of dog litter is that it is washed away by the rain and enters untreated into local streams and rivers creating a water contamination problem. In the county of Arlington, Va. it was reported in a local newspaper that upward of 11,400 pounds of untreated dog waste washed into the creek system each day. The reported result was that area streams contained a high level of fecal coliform bacteria rendering such unsafe for contact by humans.

Some persons do attempt to pick up litter deposited by their animals. However, it is usually impossible to remove all of the litter. Thus, some portion is left behind in the form of a residue or smear adhering to the grass or concrete surface which, even though less of a problem, is still a nuisance and health hazard. Many find it inconvenient to carry litter pickup items and simply use a stick to push the litter into the street gutters where they are eventually washed away untreated.

DESCRIPTION OF THE PRIOR ART

The prior art includes a number of devices designed for animal litter pick-up. Examples include U.S. Pat. Nos. 4,715,495; 4,917,238; 4,205,869; 5,265,719; and 5,222,777. Each of these patented devices provide what is referred to generally herein as a "primary" litter pickup means. There is no provision for a complete cleansing and disinfecting of the area after much or most of the litter has been picked up.

Another prior art device is disclosed in U.S. Pat. No. 4,485,971 wherein a walking cane includes a water reservoir and pumping mechanism to deliver a high pressure water stream upon animal excrement to break it up and flush the excrement into the street gutter or soil.

U.S. Patent No. 5,447,227 to Koseberg relates to a Carrying Device for Pet Supplies which do not include spray washing and sterilizing means.

A primary object of the invention is to provide a cleanup kit to enable a person walking a dog to easily carry with him certain items to enable him to remove any animal litter deposited and then to thoroughly flush and disinfect the contaminated area.

A further object is to provide a method of cleaning up and disinfecting the area where a dog has deposited feces such as on a lawn or sidewalk.

It is a further object to provide a convertible carrying bag that can be used as a "fanny pack" type carrier bag or provided with a strap and used as a shoulder bag.

A further object is to provide a method of neutralizing urine left by an animal adjacent bushes or trees or on a lawn or other surface.

It is a further object to provide an insert for converting conventional carrying bags by adding pockets to the inside thereof to be used in forming the container of applicant's kit. The insert serves to separate and support the essential kit items and any optional ones.

In this application, the expression "primary litter pickup means" refers to any means or device for picking up the larger lumps or major portion of a mass of dog feces which is also referred to herein as "litter."

DETAILED DESCRIPTION OF THE DRAWINGS

Figure 1:
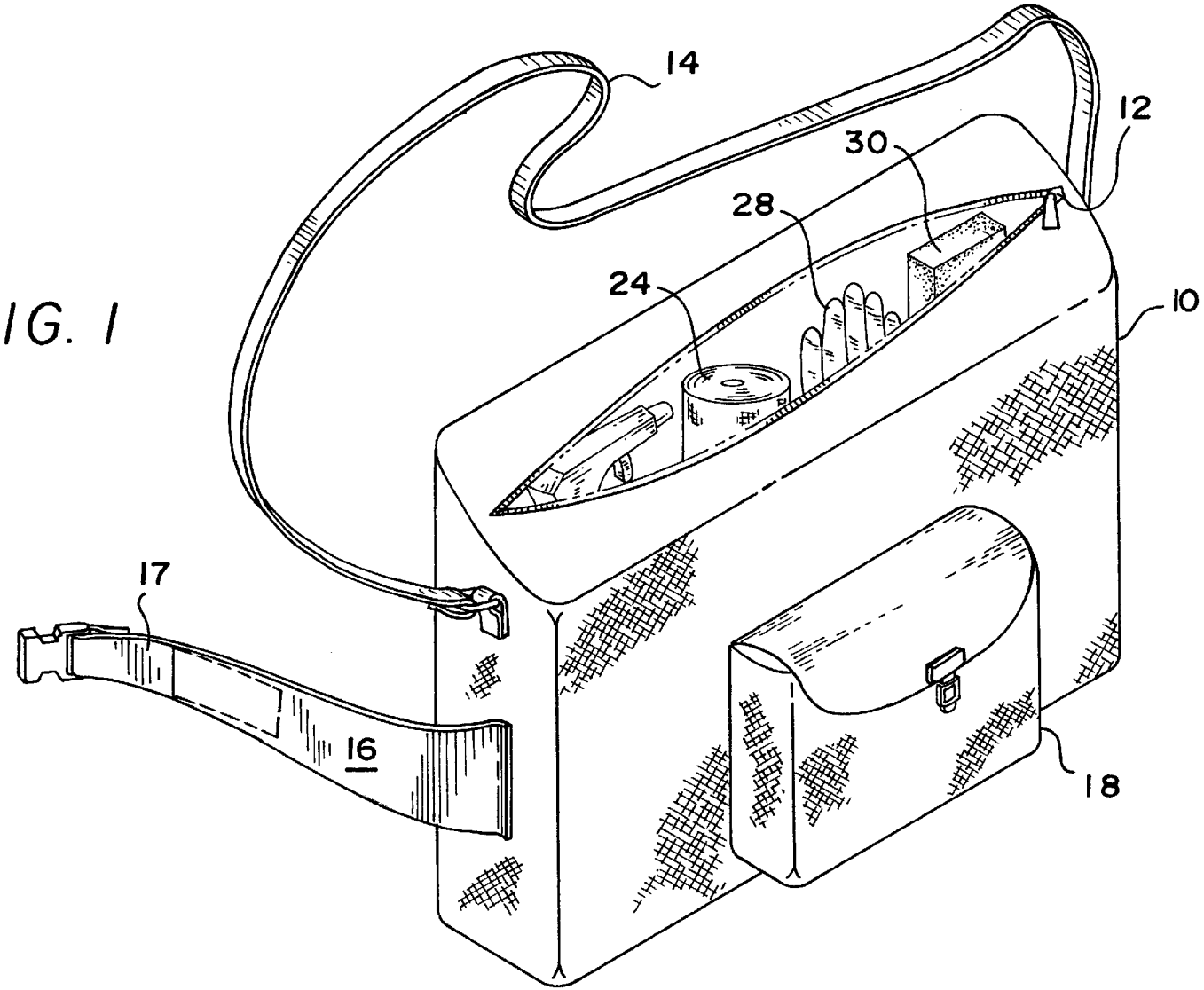
FIG. 1 is a perspective view of one form of bag adapted for use as the carrier forming the kit.
Figure 2:
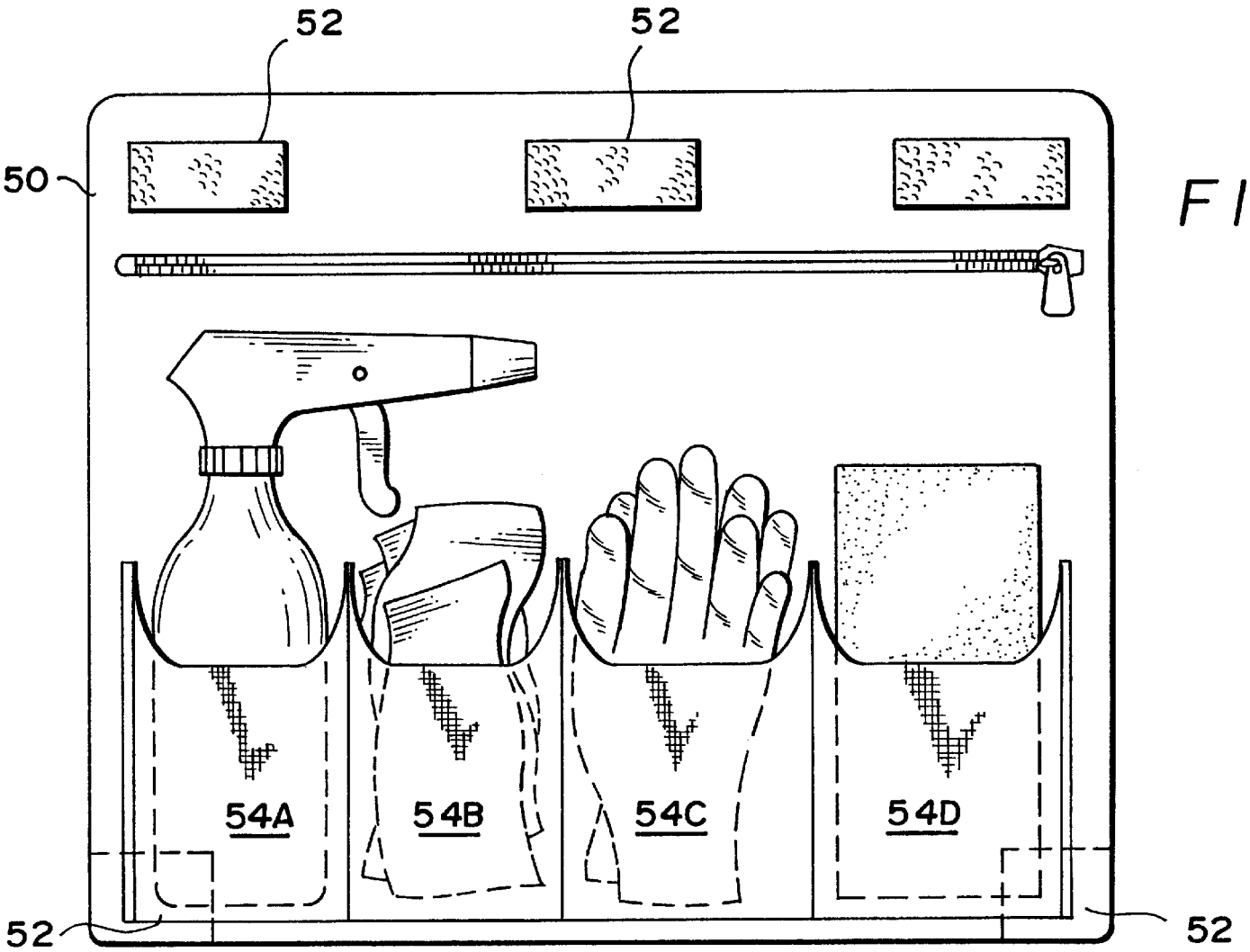
FIG. 2 illustrates the insert to be added to a conventional bag to converting it for use in separating and supporting various items of the kit.

The carrying bag for the clean up kit items may take a variety of shapes and configurations as long as it is able to hold the essential items as listed below and any optional items of personal preference. As shown in FIG. 1, the clean up kit may comprise one type of conventional soft-sided bag 10, modified to separate some of the items to be carried. The bag 10 is preferably provided with separate internal compartments of the type illustrated in FIG. 2 and preferably with some external compartments such as 18 for the items to be conveniently stored and located as needed. The bag 10 should include a shoulder strap such as 14 or a belt 17 to enable a person walking a dog to keep one hand free to hold onto the dog's leash. In a simplified version, a comparatively large waist attached bag or "fanny pack" is attached to a belt 17 by strap supporting members 16 at each end of the bag. This bag is designed to be used with either a belt 17 or the shoulder carrying strap 14. Such a carrier bag will support the spray bottle 40 in either a vertical or horizontal position. Other versions may include an additional external pocket or bottle carrier to support the spray bottle in a vertical position.

FIG. 1 shows one type of primary pickup means for removing as much of the litter as possible which, in this instance, is in the form of a roll of elongated plastic bags 24. In order to reduce bulk and weight, only a few of the bags would normally be carried in the bag at one time rather that an entire roll. The plastic bags 24 can, for example, be those which are the widely available one gallon size sold for the storage of food. A user simply inserts his hand to the bottom of a bag, then after grasping the litter, turns the bag inside out. Alternatively, the plastic gloves 28 may be used to pick up the litter and deposit it in a disposable bag. In either case, the litter is placed inside the disposable plastic bag without soiling the user's hands. The user may then place the soiled glove along with any other soiled items in the bag and seal it by any appropriate means. The kit may include another bag, preferably opaque, for transporting the now partially filled litter bag out of sight until it can be disposed. Proper disposal of the contents will depend upon local circumstances. In some areas "double bagging" of animal litter is required before depositing in the garbage. In other areas rather than merely discarding the bag and its contents (either single or double bagged) in a trash can, a different procedure, such as, flushing the contents down a toilet. Alternatively, the litter could be neutralized and deactivated of harmful bacteria by composting with other materials. A wide variety of "primary" litter collection means can be used, such as that described in U.S. Pat. No. 4,205,869 and numerous others. As stated above, the particular type of primary litter pick-up means is not critical to the invention. A variety of primary litter pick-up means are available and more than one type could be carried in the kit for selective use depending on the situation. In any event, the invention includes as a first step the immediate removal of as much as possible (the primary portion) of the animal feces from the lawn, sidewalk or street and not left to be washed untreated into the streams and rivers.

As pointed out above, regardless of the type of primary litter pick-up means used a residue or smear usually remains on the surface where the litter was deposited, whether it is grass, concrete, or any other surface. If such residue is allowed to remain it is still an environmental nuisance and potential health hazard. Applicant has discovered that this residue or smear can be substantially completely washed away and the area disinfected using a relatively inexpensive and widely available hand held sprayer such as the trigger sprayer shown at 40 and the disclosed solution. Thus, an essential item included in the kit is a spray bottle such as the one shown at 40. The spray bottle 40 may comprise one of the many transparent types now widely available and used, for example, for various cleaner solutions. A preferred type are those which have an adjustable spray/stream type nozzle with the capacity to repeatedly produce a somewhat high pressure liquid stream generally needed in order to dissolve and flush away any remaining solid litter residue from a grassy surface or concrete surface. On lawns or other grassy areas the small amount of used spray wash water may simply drain down through the grass into the soil where it will be absorbed and neutralized by natural environmental cleansing action. Spray bottle 40 having the trigger operated spray head 42 may simply contain water for some situations. However, in order to thoroughly disinfect an area from harmful bacteria and parasites that normally exists in animal feces the water may contain an agent such as chlorine bleach which when diluted as directed has been found by the inventor to be harmless to grass and concrete. As an option, a second possibly smaller spray bottle may be included in the kit containing a mixture of water and chlorine bleach solution to be used after the residue has been dissolved and flushed with water to give the area a bacteria killing final spray rinse. As an example, one such agent is Chlorox @ bleach which may be mixed at the strength of ¾ cup to a gallon of water. As stated above this solution is harmless to grass and concrete when mixed as stated and could in most instances, be used as the primary washing liquid as well as only being used in a final spray rinse. In some instances it might be appropriate for the excess liquid to be wiped up with a paper towel. A brush could be included for hard to remove portions.

The same solution described above can be used for neutralizing any urine left by the animal on grass or small trees and bushes to reduce possibility of damage thereto and "burned" spots on lawns.

The bag may conveniently include additional pockets for the storage and inclusion of other items that a person may wish to include each time he takes an animal for a walk. Such items may include a collapsible umbrella, extra bags 24 or other primary litter pick-up devices, plastic gloves 28, paper towels, sponge, a small brush 30 for stubborn residue on concrete, an animal or and human repellent, a headphone radio, etc. It is apparent that the bag performs multiple functions in that it serves as a convenient home storage container for all items needed when the animal is taken for a walk, including the leash, making the needed items easily transportable.

Many dog owners prefer to walk their dogs after dark, especially in the summer when the temperature is cooler. In such instance, a conventional flashlight, such as the one shown at 30 would be useful to locate the litter and then light up the area while it is being cleaned. Again, any type of flashlight may be used. A convenient pocket 18 on the outside of the bag is preferred for quick access to the flashlight.

One of the features of the kit is that each of the items suggested above including the trigger sprayer is usually already in the possession of most dog owners. Thus, the pet owner may simply collect and store in the bag the main kit items and other optional items ready for use. Such is also generally true of the bag forming the kit container.

Most persons already own at least one bag that can be converted for use with the kit. The inventor has designed an insert 50 that may be quickly and simply fitted within and attached to virtually any bag of appropriate size and shape selected depending upon the number of items to be carried the size of the dog, etc. The insert 50 includes a somewhat flexible backing sheet 51 that may be trimmed to fit within a variety of available bags presently on the market. On the front of the backing sheet 51 a strip of mesh or other material is attached, such as by sewing, at spaced locations to form pockets 54A–54D. The pockets are of appropriate size to receive the trigger spray bottle 40 and a number of the other described items such as flashlight, plastic gloves, sponge, paper towels, brush, etc. Obviously, the bag could be initially constructed with the insert permanently secured therein rather than added later.

Suitably positioned on the rear surface of the backing sheet are patches 32 of hook and loop material. A detachable mating piece of the hook and loop material is provided and is adapted to be secured to the inner surface of the bag after properly locating the insert in the bag.

If desired, a second insert 50 can be placed on the opposite side wall of the bag to retain additional items or spares.

The cleanup kit enables a person walking a dog to become more environmentally friendly and not to be a cause of irritation to neighbors who might previously have viewed him as a spreader of contamination and disease wherever he walks his pet. In this regard, the bag may include an appropriate external insignia to indicate its environmental friendly purpose.

Having described my invention I now claim:

1. A method of cleaning up dog litter while walking a dog out of doors comprising:

placing pieces of the dog litter in a single use container for disposal, spraying the area where the dog litter was deposited with a trigger operated sprayer containing water and a disinfectant to dissolve, disinfect and flush into the soil any remaining litter residue or particles from the littered surface area.

2. The method of claim 1, wherein said disinfectant is sodium hypochlorite.

* * * * *